US006730852B1

(12) United States Patent
Puigcerver et al.

(10) Patent No.: US 6,730,852 B1
(45) Date of Patent: May 4, 2004

(54) FLEXIBLE DISTRIBUTION LINE COVER AND METHOD OF INSTALLING THE SAME

(75) Inventors: Luis Orlando Puigcerver, Raleigh, NC (US); David Edwin Bowling, Fuquay Varina, NC (US); Laura Jackson Hiller, Cary, NC (US); Terry Edward Frye, Cary, NC (US); Carl Michael Stine, Tracy, CA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/336,272

(22) Filed: Jan. 3, 2003

(51) Int. Cl.[7] ..... H01B 17/56
(52) U.S. Cl. ..... 174/138 F; 174/5 R; 174/139
(58) Field of Search ..... 174/5 R, 40 R, 174/135, 138 F, 139, 140 H

(56) References Cited

U.S. PATENT DOCUMENTS 881,682 A * 3/1908 Harrison et al. ..... 174/5 R
992,738 A * 5/1911 Marshall ..... 174/5 R
1,141,674 A * 6/1915 Withers ..... 174/5 R
1,180,729 A * 4/1916 Marshall ..... 174/5 R
3,328,511 A * 6/1967 Cagle et al. ..... 174/45 R
3,835,238 A * 9/1974 West ..... 174/5 R
3,900,698 A * 8/1975 Yotsugi ..... 174/5 R
4,234,753 A * 11/1980 Clutter ..... 174/5 R
4,280,013 A * 7/1981 Clutter ..... 174/5 R
4,845,307 A * 7/1989 Cumming et al. ..... 174/5 R
5,873,324 A 2/1999 Kaddas et al. ..... 119/174
6,005,196 A * 12/1999 Spillyards ..... 174/138 F
6,255,597 B1 * 7/2001 Bowling et al. ..... 174/138 F

* cited by examiner

*Primary Examiner*—Dean A. Reichard
*Assistant Examiner*—Adolfo Nino
(74) *Attorney, Agent, or Firm*—Myers Bigel Sibley & Sajovec

(57) ABSTRACT

Covers for distribution lines coupled to an insulator include a main body of a flexible polymer material. The main body is configured to be positioned adjacent the insulator and a line coupled to the insulator. At least one connector member is connected to the main body. The connector member is a rigid material configured to couple to either the insulator or the line to attach the cover.

39 Claims, 20 Drawing Sheets

FLEXIBLE DISTRIBUTION LINE COVER AND METHOD OF INSTALLING THE SAME

BACKGROUND OF THE INVENTION

The present invention relates to protective covers and, more particularly, to protective covers for distribution lines, such as power distribution lines, and methods for installing the same.

Support structures, such as utility poles, are often used to suspend electrical lines, such as power distribution lines, above the ground. These support structures are generally located outdoors and may be of a variety of different configurations to suspend one or more lines. One problem with such lines, particularly where the lines are power distribution lines that transmit electrical power at high voltages, is that birds or other animals may land or climb onto the lines. Such contact of distribution lines by animals, particularly adjacent the support structure, may result in a shock to the animal, possibly resulting in the death of the animal, if the animal causes a short or electrical flashover allowing current to flow through the animal.

For example, it is known that birds from time to time perch on support structures such as utility poles. For certain birds, their wing span is great enough to contact two parallel lines or otherwise create an electrical flashover during take off or landing. In addition, to harming the bird, such an electrical flashover can also cause a power outage or other problem with the power distribution system.

Various covers have been proposed to reduce the risk of electrical shorts at utility poles. For example, U.S. Pat. No. 5,873,324 describes a bird guard wire protector made of electrical insulating material. The protector has a central member sized and shaped to fit over the top of an insulator attaching a power wire to a support structure. The central member has a first connecting structure and a second connecting structure unitarily formed therewith and extending away therefrom. A first arm is connected to the first connecting structure to extend away therefrom and a second arm is connected to the second connecting structure to extend away therefrom.

Problems may be encountered with such unitary structure covers as the lines extending from the insulator at the support structure may extend from the insulator at different angles. Accordingly, it is known to heat such structures in the field so that they may be bent to a desired angle for attachment to a particular utility pole. However, this generally requires additional equipment and procedures, typically in the field, to prepare the cover for installation.

SUMMARY OF THE INVENTION

Embodiments of the present invention provide covers for distribution lines coupled to an insulator. Such a cover includes a main body of a flexible polymer material. The main body is configured to be positioned adjacent the insulator and a line coupled to the insulator. The adjacent position may be completely over or partially over and/or aside the insulator. At least one connector member is connected to the main body. At least one connector member is a rigid material as compared to the main body material and is configured to couple to the insulator and/or the line to attach the cover. In various embodiments of the present invention, the main body material has a tensile strength of less than about 2500 pounds per square inch (psi) and the at least one connector member has a tensile strength greater than the main body material and at least about 1200 psi. The flexible polymer material and the rigid material may be track resistant polymer materials In further embodiments of the present invention, the main body includes a central portion configured to be positioned adjacent the insulator. A first line cover portion extends from the central portion and a second line cover portion extends from the central portion in a direction substantially opposite from the first line cover portion. The first and second line cover portions may also each include a corrugated portion adjacent the central portion that further increases rotational flexibility of the line cover portions relative to the central portion. The connector member(s) may be selected from the group consisting of a mechanical clamp, a displacement spring clip, a swinging clamp and a ratcheting clamp. In particular embodiments, the connector member(s) are displacement clip(s) molded into the main body. In some embodiments, the connector member(s) are coupled to the main body by fastener(s), such as threaded fastener(s).

In other embodiments of the present invention, an extender arm is coupled to the first line cover portion and extends from the central portion. The extender arm may be a rigid material and may be the same material as the connector member(s). In particular embodiments, at least one of the connector member(s) is a displacement clip and the extender arm and the at least one connector member(s) have substantially identical profiles, such as an omega profile. A second extender arm may be coupled to the second line cover portion and extend in a direction substantially opposite from the first line cover portion.

In further embodiments of the present invention, a releasable snap connector couples the extender arm to the first line cover portion. The snap connector may be a tab portion on an end of one of the first line cover portion and the extender arm and a corresponding opening on an adjacent end of the other of the first line cover portion and the extender arm. Alternatively, other type of connectors, such as fasteners, may be used to couple the extender arm to the line cover portion.

In other embodiments of the present invention one of the connector members is positioned in the first line cover portion to couple to a line extending from the insulator in a first direction and another of the connector members is positioned in the second line cover portion to couple to a line extending from the insulator in a second direction different from the first direction. A third connector member may be positioned in the central portion to couple to the insulator. The cover may further include an installation aid attachment portion in at least one of the main body and at least one connector member, the installation aid attachment portion being configured to engage an end of an installation aid, such as a hot stick, for installation of the cover on the distribution lines.

In further embodiments of the present invention, the rotational flexibility of the line cover portions accommodates a deviation of tip to about 25 degrees between an axis defined by a line extending from the insulator under the first line cover portion and an axis defined by a line extending from the insulator under the second cover portion. The line extending from the insulator under the first line cover portion and the line extending from the insulator under the second cover portion may be the same line, such as a power line passing by the utility pole and connected to the utility pole by an insulator.

In other embodiments of the present invention, methods are provided for covering distribution lines coupled to an insulator. A cover is provided comprising a main body of a flexible polymer material configured to be positioned adjacent the insulator and at least one connector member connected to the main body, the connector member being a rigid material. The cover is placed adjacent the insulator. An end of the main body is flexed to align with one of the distribution lines extending from the insulator. The connector member is connected to at least one of the insulator or the one of the distribution lines. Connecting the connector member may include connecting the connector member to the insulator. A connector member may instead or also be positioned in the end of the main body and connecting the connector member may include connecting the connector member to the one of the distribution lines.

In further embodiments of the present invention, a plurality of connector members are provided and flexing an end of the main body includes flexing a first end of the main body to align with a first line extending from the insulator in a first direction. A second end of the main body is flexed to align with a second line extending from the insulator in a second direction, different from the first direction. A first one of the connector members in the first end is connected to the first line and a second one of the connector members in the second end of the main body is connected to the second line. A third one of the connector members may be positioned in the main body and connected to the insulator.

In other embodiments of the present invention, an extender arm is connected to the first end of the main body. The extender arm is positioned to extend over the first line in the first direction. Another extender arm may be connected to the second end of the main body. The second extender arm is positioned to extend over the second line in the second direction.

DETAILED DESCRIPTION

Figure 1A:
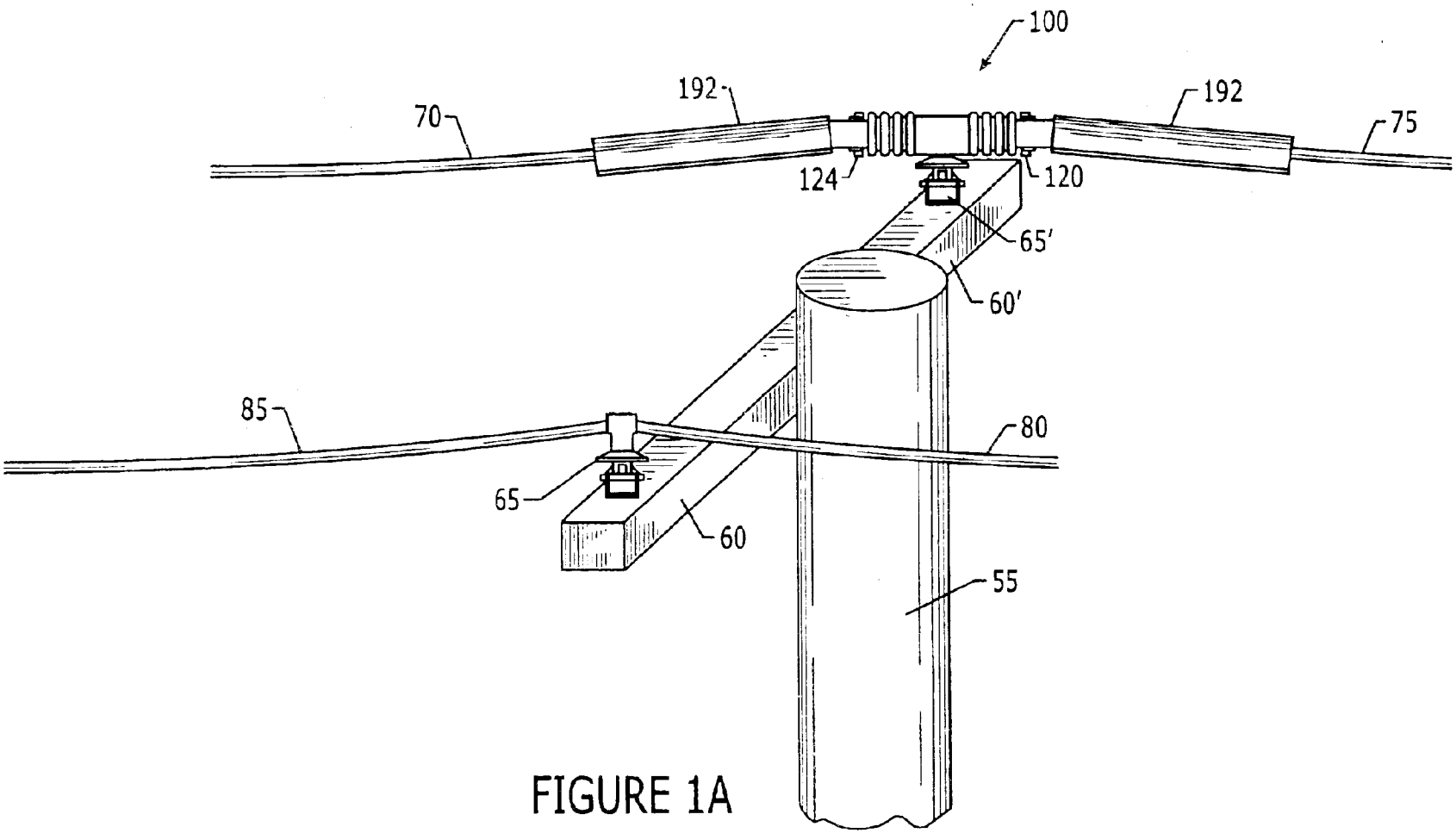
FIG. 1A is a schematic diagram illustrating a cover for distribution lines according to some embodiments of the present invention applied to power distribution lines at a utility pole.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not he construed as limited to the embodiments set forth herein, rather, these embodiments are provided so that this disclosure will be thorough and complete, and will fully convey the scope of the invention to those skilled in the art.

Embodiments of the present invention will now be described with reference to the various embodiments illustrated in FIGS. 1–15. FIG. 1A is a schematic illustration of a cover 100 according to some embodiments of the present invention installed over an insulator on a utility pole of a power distribution system. It is to be understood that utility poles, such as the utility pole 55 of FIG. 1, may take a variety of configurations, sizes and shapes for supporting one or more utility lines including, for example, power distribution/transmission lines. The poles may be used to support the lines high above the ground. Birds have been known to land and perch on the pole 55, as well as on the associated cross members 60, 60', lines 70, 75, 80, 85 and insulators 65, 65'.

Some birds having large wing spans and are vulnerable to shock and electrocution from electrical power lines. In particular, birds of prey, such as raptors (eagles, osprey, owls and so on) and other large birds may have sufficient wing spans so that the bird with wing extended can contact two adjoining power lines or wires mounted to the same power pole. The lines at the pole, although not necessarily parallel, may be sufficiently proximate so that the wings of a bird can span the distance between the two lines proximate the support structure or utility pole. When the bird takes off or lands, the wings are extended and may extend or present a wing span sufficient for the wings to touch and cause an electrical short between the two lines and, in turn, may lead to a short circuit and shock or electrocution of the bird. Electrical service interruptions may also result.

FIG. 1A illustrates a utility pole 55 having a cross bar 60, 60' mounted near the top of the pole. A first power line extending from an insulator 65 defines a first line 70 extending from the insulator 65 in a first direction and a second line 75 extending from the insulator 65 in a second direction. An axis defined by the first line 70 and an axis defined by the second line 75 may not be parallel and define an angle of alignment of the lines 70, 75 relative to the insulator 65. Similarly, lines 80, 85 extend from the insulator 65'. The insulators 65, 65' may, for example, be made of glass, porcelain, polymer, or similar insulating material. The insulators 65, 65' may be secured by bolts or other similar structures to fasten them to the cross bar 60, 60'. The power line 80, 85 is in turn coupled to the insulator 65 and the power line 70, 75 is coupled to the insulator 65' to provide an electrically insulated attachment of the power lines to the utility pole 55.

As shown in FIG. 1A, the cover 100 is positioned adjacent to and partially covering the insulator 65' and over portions of the first line 70 and the second line 75. The cover 100 also includes connector members 120, 124, respectively connected to the second line 75 and the first line 70. A third connector member may be coupled to the insulator 65'. In addition, extender arms 192, 192' are shown connected to the main body of the cover 100 and extending therefrom over the lines 70, 75, respectively.

Although the first line 70 and the second line 75 are shown as being in substantially parallel alignment in FIG. 1A, lines mounted to a support structure may extend in different directions from an insulator and need not be straight or in axial alignment. The lines 70, 75, 80, 85 arc also shown in FIG. 1A as being located substantially in the same plane or at the same elevation above the ground. However, multiple cross bars may be mounted to the pole 55 at different heights with lines at different elevations. Furthermore, the insulators may extend vertically or horizontally from the cross members or directly from the pole. The precise configuration and orientation of the support structure, as well as the orientation of the supported lines may, therefore, vary from that shown in FIG. 1A and the present invention is not limited to use with the particular support structure configuration shown in FIG. 1A.

Figure 1B:
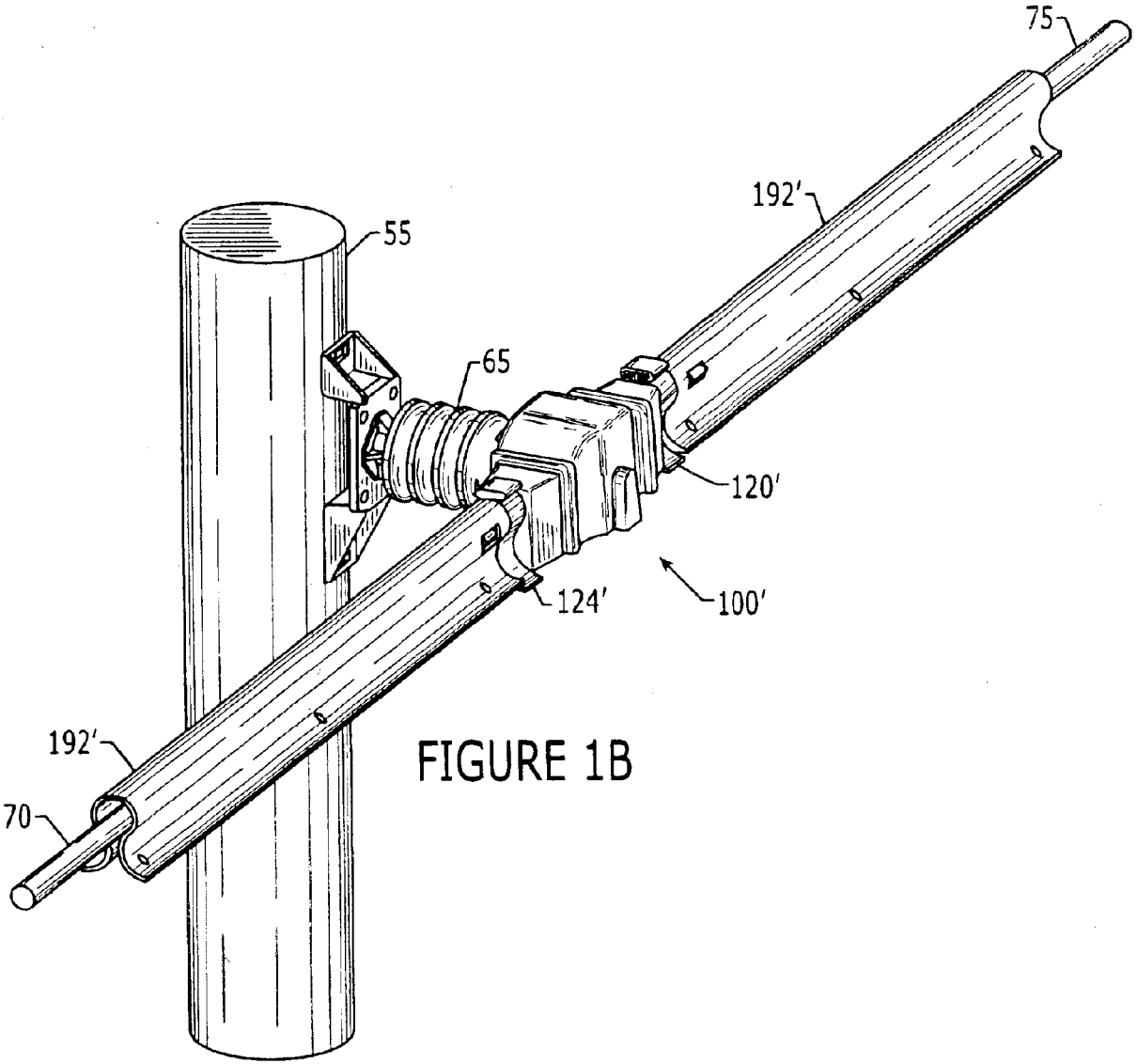
FIG. 1B is a schematic diagram illustrating a cover for distribution lines according to other embodiments of the present invention applied to power distribution lines at a utility pole.

FIG. 1B illustrates further embodiments of a cover 100' positioned adjacent an insulator 65 extending horizontally from a utility pole 55. The cover 100' includes first and second connector members 120', 124' connected to the line 70, 75. Extender arms 192' are shown connected to the main body of the cover 100' and extending along the line 70, 75 from the main body. The cover 100' is positioned aside and partially covering the insulator 65 while the cover 100 of FIG. 1 A is illustrated as over and covering the vertically extending insulator 65'.

Embodiments of a cover for distribution lines attached to a insulator will now be further described with reference to the exploded perspective illustration of FIG. 2. As shown for the embodiments of FIG. 2, the cover 200 includes a main body 210 and three connector members 220, 222, 224. The connector members 220, 222, 224 are made from a rigid material as contrasted with the flexible polymer material of the main body 210. The main body 210 may, for example, be a flexible track resistant material, such as an insulating grade, ultra-violet (UV) stable polymer. The material of the main body 210 in particular embodiments has a tensile strength from about 1000 pounds per square inch (psi) to about 2500 psi. The connector members 220, 222, 224 may also be a polymer, such as an insulating track resistant polymer. More particularly, the the connector members 220, 222, 224 are more rigid than the main body 210. In particular embodiments, the tensile strength of the connector members 220, 222, 224 ranges from about 1200 psi to about 10,000 psi. In some embodiments, the main body 210 has a tensile strength of less than about 2500 psi and the connector members 220, 222, 224 have a tensile strength greater than the main body 210 and at least about 1200 psi.

By providing different rigidity materials for the main body 210 and the connector members 220, 222, 224, reliable holding strength may be provided on lines extending from the insulator while still providing a flexible configuration so as to adjust to various angles of approach of the lines to the insulator. The rigid connector members 220, 222, 224 may provide a reliable grip on the distribution lines while the main body 210 may be flexed to adjust to the angles. The use of a track resistant material in particular embodiments may provide long-term reliability substantially equivalent to the expected lifetime of typical insulators and distribution lines. Accordingly, the use of a cover, such as the cover 210, installed on distribution lines, such as power lines, at insulator connection points may help to prevent animal caused electrical flashovers.

Figure 2:
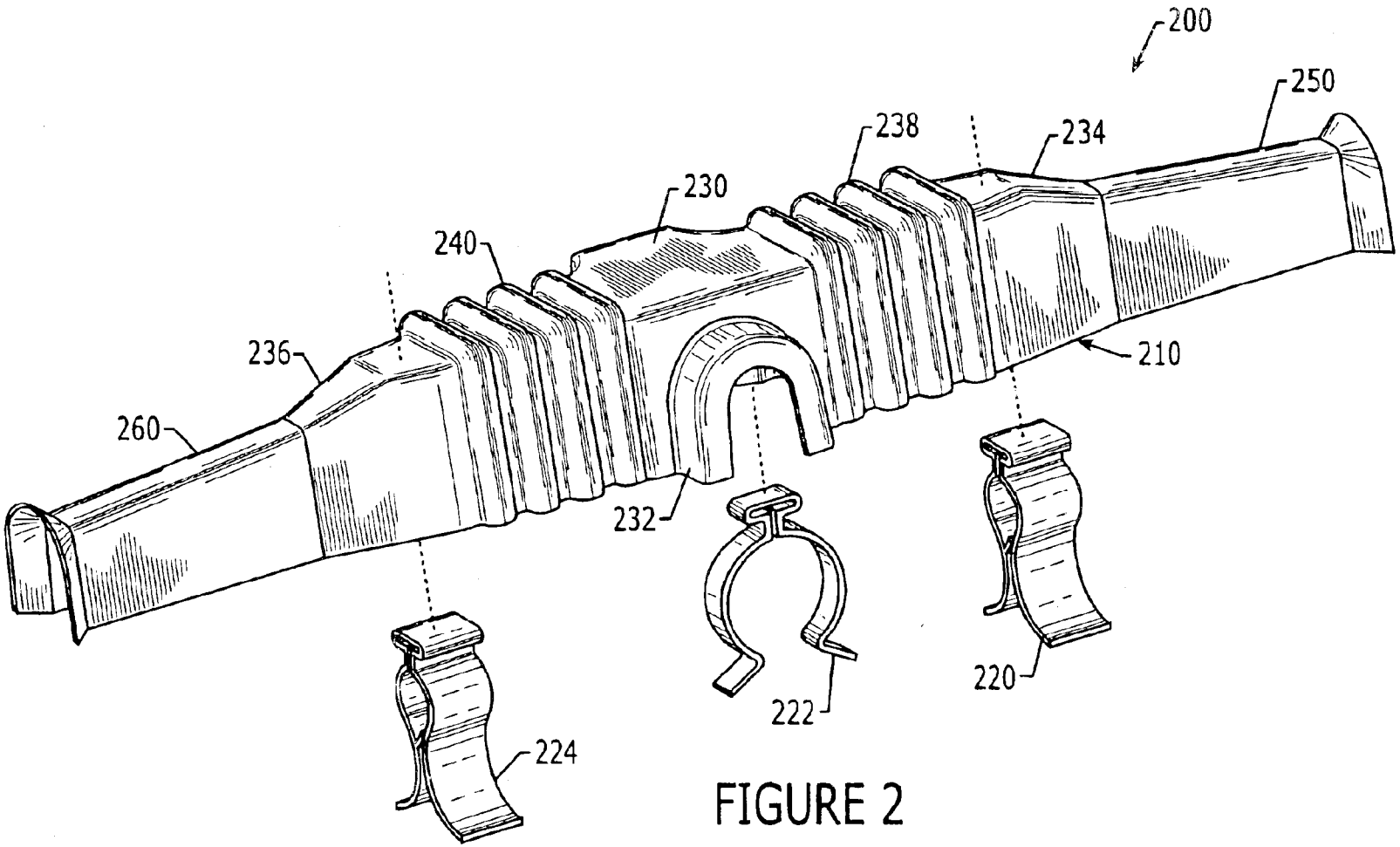
FIG. 2 is an exploded perspective view of a cover for distribution lines according to some embodiments of the present invention.

As shown in FIG. 2, the main body 210 includes a central portion 230 configured to be positioned adjacent and partially over an insulator. The relationship of embodiments such as those shown in FIG. 2 to an insulator is further illustrated in FIG. 8B, which illustrates a main body 710 installed over an insulator 701 and distribution lines 703, 704 extending from the insulator 701. As can be seen from the arrangement in FIG. 8B, the central portion 230 of FIG. 2 includes a connection chamber 232 configured to receive the connector member 222, which in turn couples to the insulator.

Referring again to FIG. 2, the main body 210 further includes a first line cover portion 234 extending from the central portion 230 and a second line cover portion 236 extending from the central portion 230 in a direction substantially opposite from the first line cover portion 234. The first line cover portion 234 includes a corrugated portion 238 adjacent the central portion 230 that increases rotational flexibility of the first line cover portion 234 relative to the central portion 230. The use of a corrugated portion 238 may further extend the adjustability of the cover 200 for different line approach angles to the insulator beyond the flexibility and range provided by the use of the flexible material for the main body 210. Similarly, the second line cover portion 236 illustrated in FIG. 2 includes a corrugated portion 240 adjacent a central portion 230 that increases rotational flexibility of the second line cover portion 236 relative to the central portion 230. Also shown in the embodiments of FIG. 2 are an extension portion 250 extending from the first line cover portion 234 and extension portion 260 extending from the second line cover portion 236. In various embodiments, the extension portions 250, 260 may be extender arms coupled to the respective line cover portions 234, 236 and/or may provide a connector region to which an extender arm may be attached.

As shown in FIG. 2, the connector members 220, 222, 224 are displacement spring clip type connectors. More particularly, the line connector members 220, 224 are omega clip type connectors. However, a variety of other types of connectors may be used in various embodiments of the present invention including mechanical clamps, swing clamps, ratcheting clamps, and the like. Furthermore, while the embodiments illustrated in FIG. 2, include three connector members, with one connector member 220 in the first line cover portion 234 to couple to a line extending from an insulator in a first direction and a second connector member 224 positioned in the second line cover portion 236 to couple to a line extending from the insulator in a second direction and a third connector member 222 positioned in the connection chamber 232 to couple to the insulator, the present invention is not limited to such embodiments and may use more or less connector members than illustrated in FIG. 2.

Figure 3:
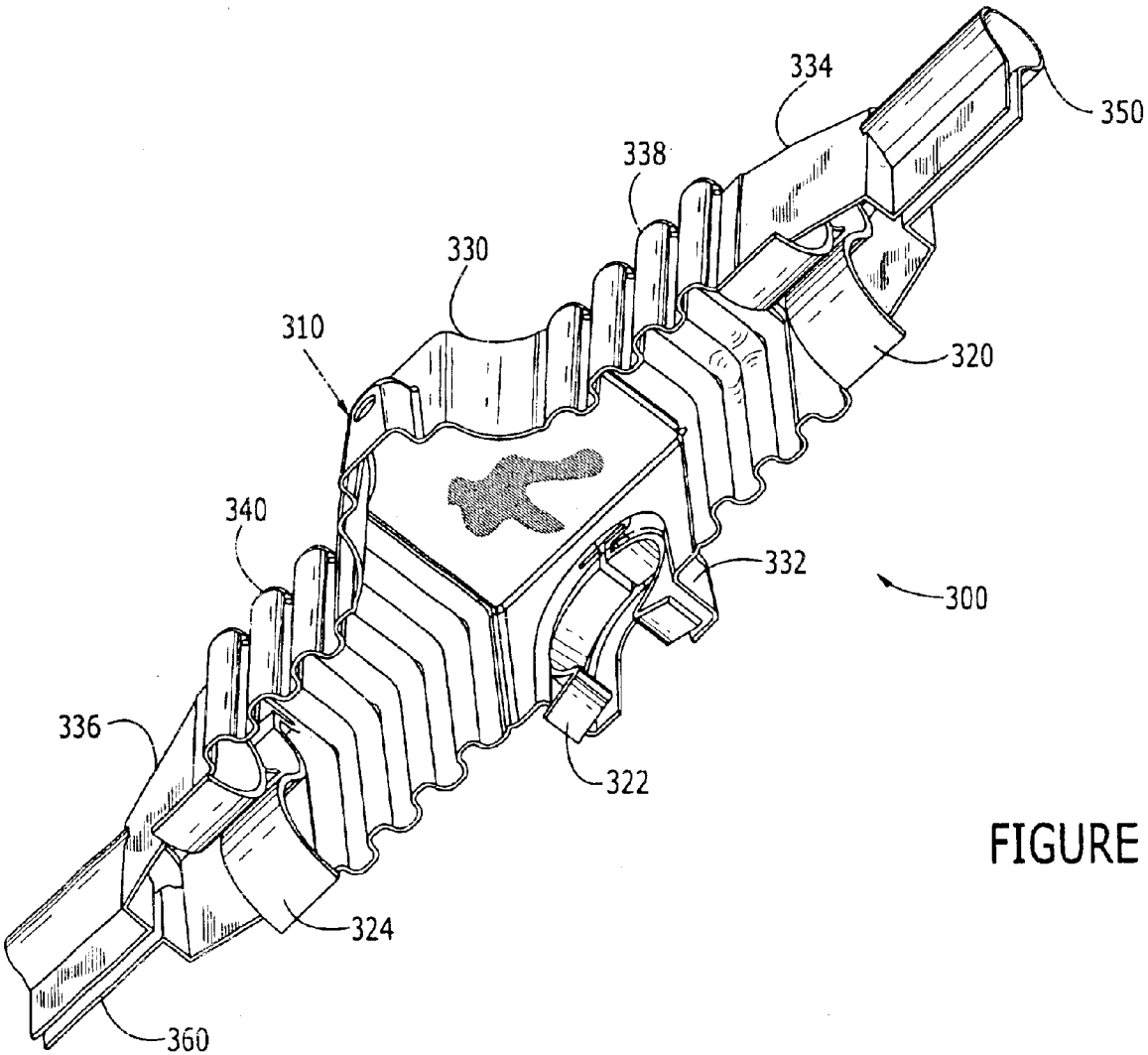
FIG. 3 is a bottom perspective view of a cover for distribution lines according to some embodiments of the present invention.
Figure 4:
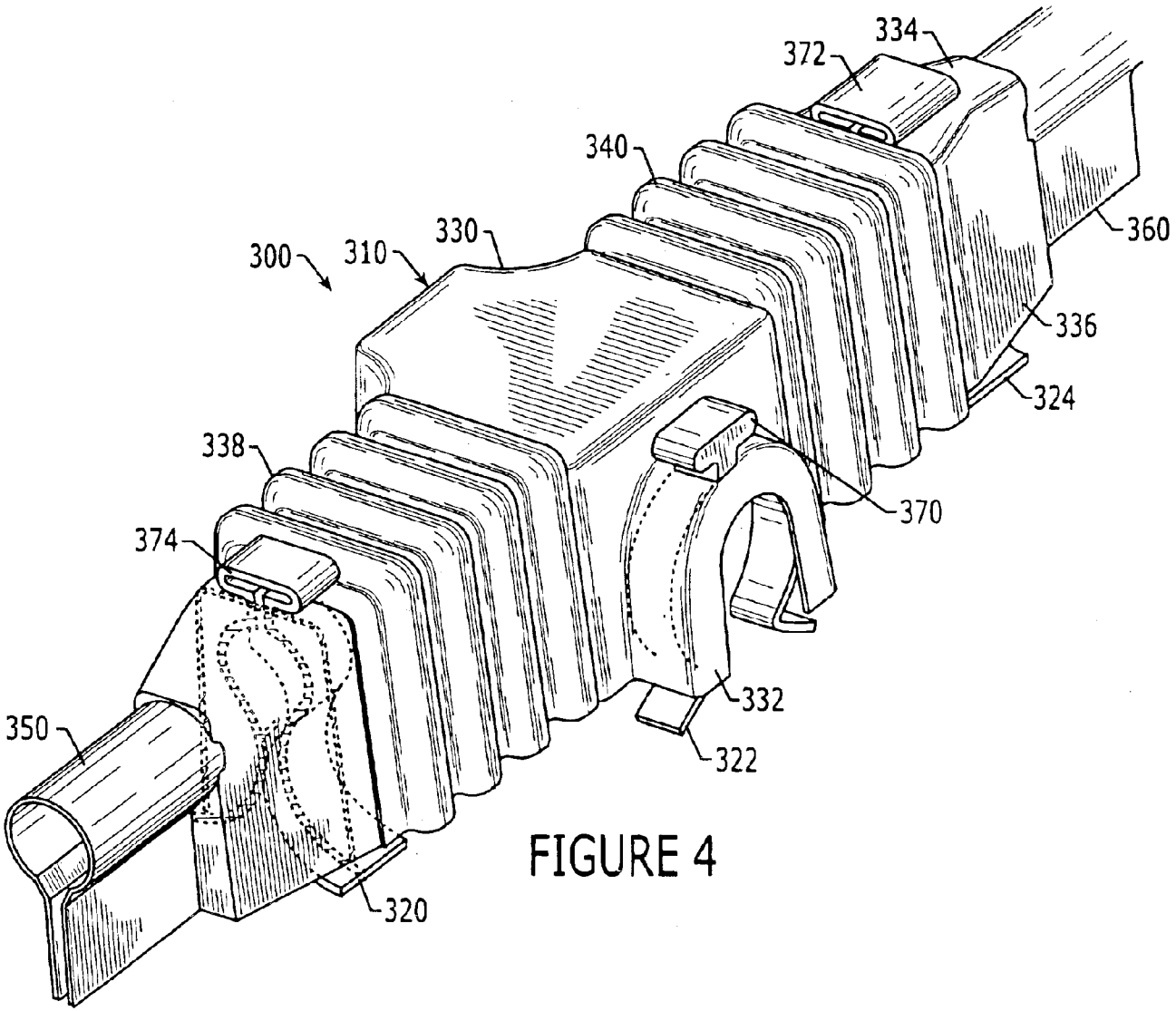
FIG. 4 is a top perspective view of a cover for distribution lines according to some embodiments of the present invention.

Referring now to the perspective view illustration of FIGS. 3 and 4, further embodiments of the present invention will now be described. As shown for the cover 300 in FIGS. 3 and 4, three connectors members 320, 322, 324 are connected to the main body 310. The main body 310 includes a central portion 330 and first and second line cover portions 334, 336 including respective corrugated portions 338, 340. The connector member 322 is positioned in the connection chamber 332 of the central portion 330. The connector member 320 is positioned in the line cover portion 334 while the connector member 324 is positioned in the line cover portion 336. An extender arm connecting portion 350 extends from the line cover portion 334 while an extender arm connector portion 360 extends from the line cover portion 336. As further illustrated in FIG. 4, for the cover 300, the connector members 320, 322, 324 are molded into the main body 310 in respective regions 370, 372, 374 of the main body 310. However, as shown it alternative embodiments of a cover 400 illustrated in FIG. 5, the connector members may be coupled to the main body in a variety of fashions.

Figure 5:
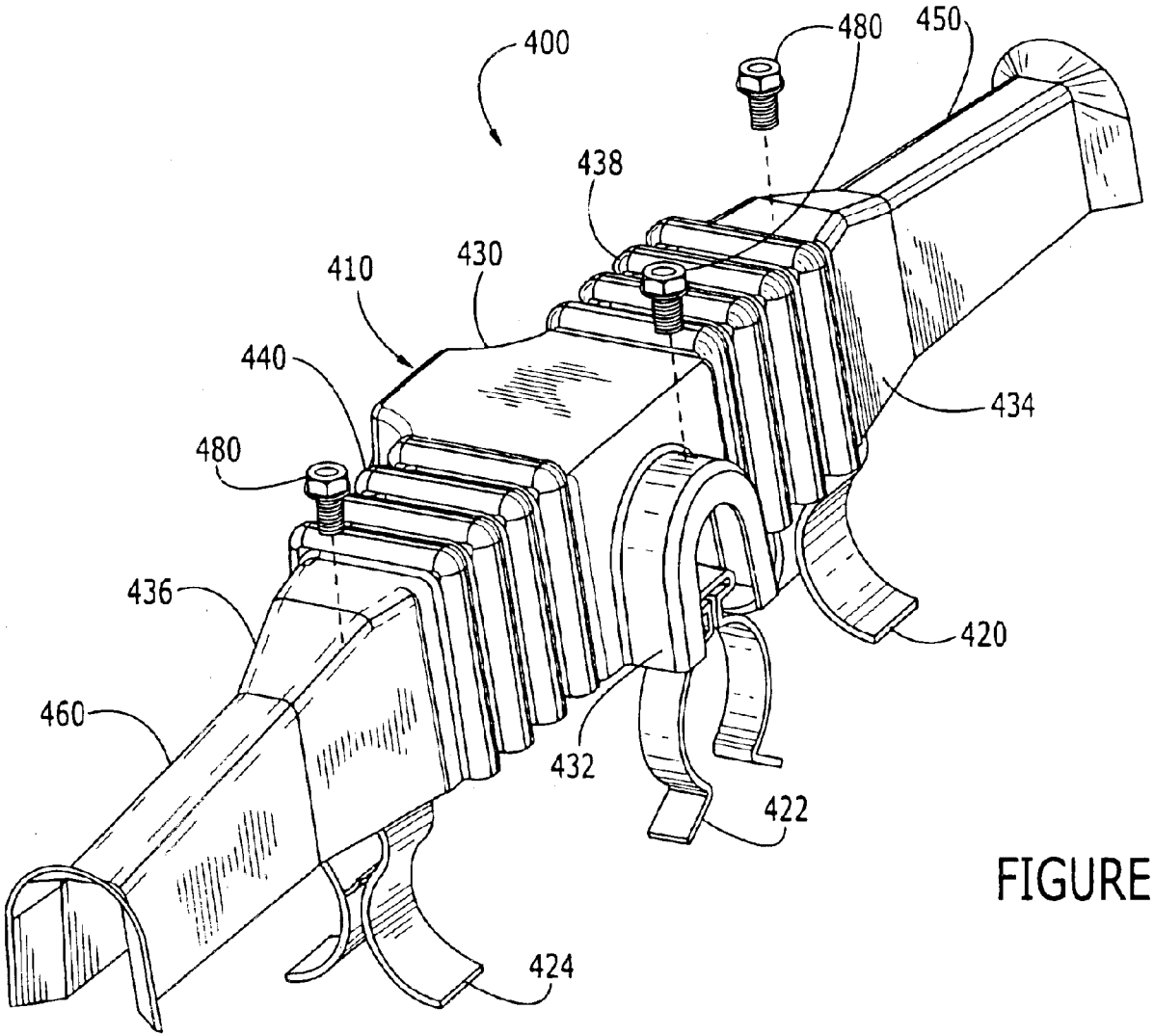
FIG. 5 is a top exploded perspective view of a cover for distribution lines according to some embodiments of the present invention.

Referring to FIG. 5, the cover 400 includes a main body 410 and connector members 420, 422, 424. The main body 410 includes the central portion 430 having a connection chamber 432 that receives the connector member 422. Line cover portions 434, 436 extend from the central portion 430 in respective directions. The line cover portions 434, 436 include corrugated portions 438, 440. Extension portions 450, 460 extend from the respective line cover portions 434, 436 to provide additional length of coverage over lines extending from an insulator protected by the cover 400.

Also showing in the embodiments illustrated in FIG. 5 are fasteners 480. The fasteners 480 connect the respective connector members 420, 422, 424 to the main body 410. For the embodiments illustrated in FIG. 5, the fasteners 480 are threaded fasteners. The threaded fasteners 480 may be self-tapping fasteners or a passage may be provided through the main body 410 and a threaded passage may be provided in the upper portions of the connectors members 420, 422, 424 to allow screwing of the fasteners 480 into the connector members 420, 422, 424. Also, the fasteners may be inserted first through passages in the connector members and threadably engage the main body. While the fasteners 480 are illustrated in FIG. 5 as threaded fasteners, it is to be understood that a variety of different types of known connectors may be used in place of the threaded fasteners such as molded in place connector, a one-way fastener/clip and the like.

Figure 6A:
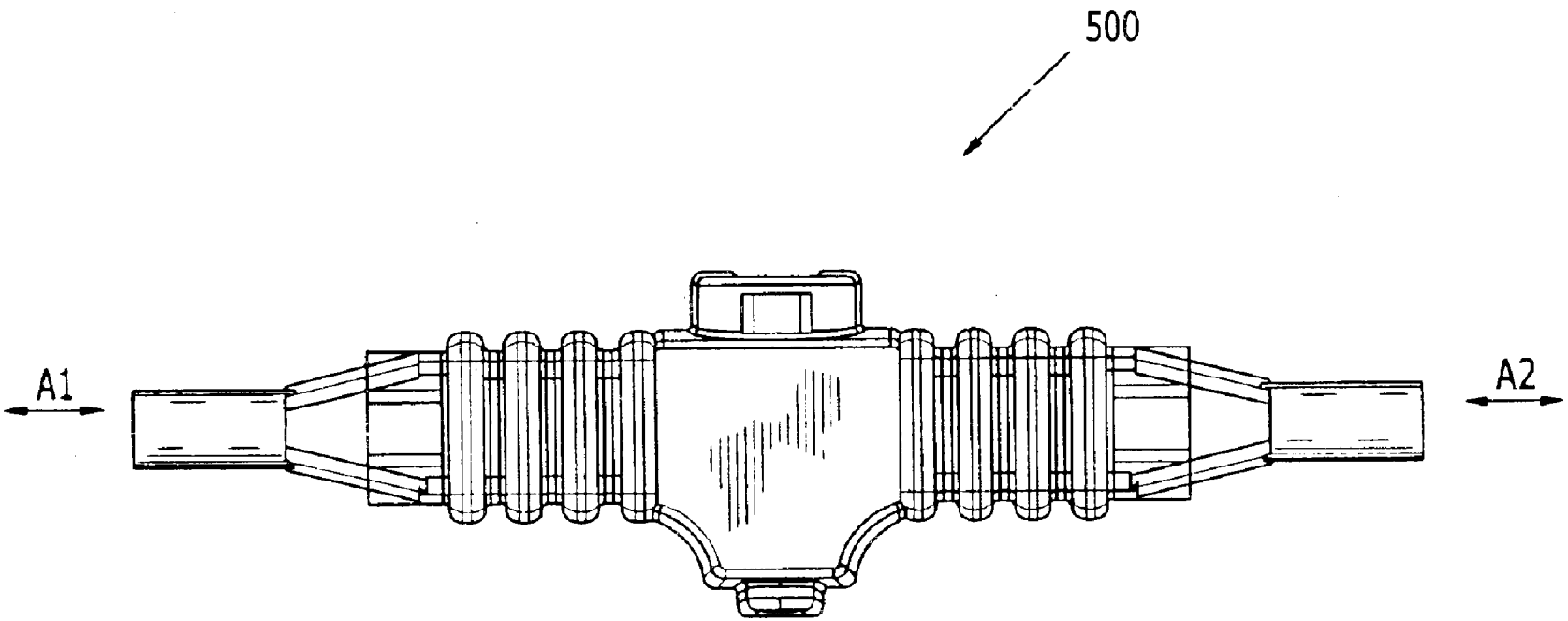
FIG. 6A is a top plane view of a cover for distribution lines according to some embodiments of the present invention.
Figure 6B:
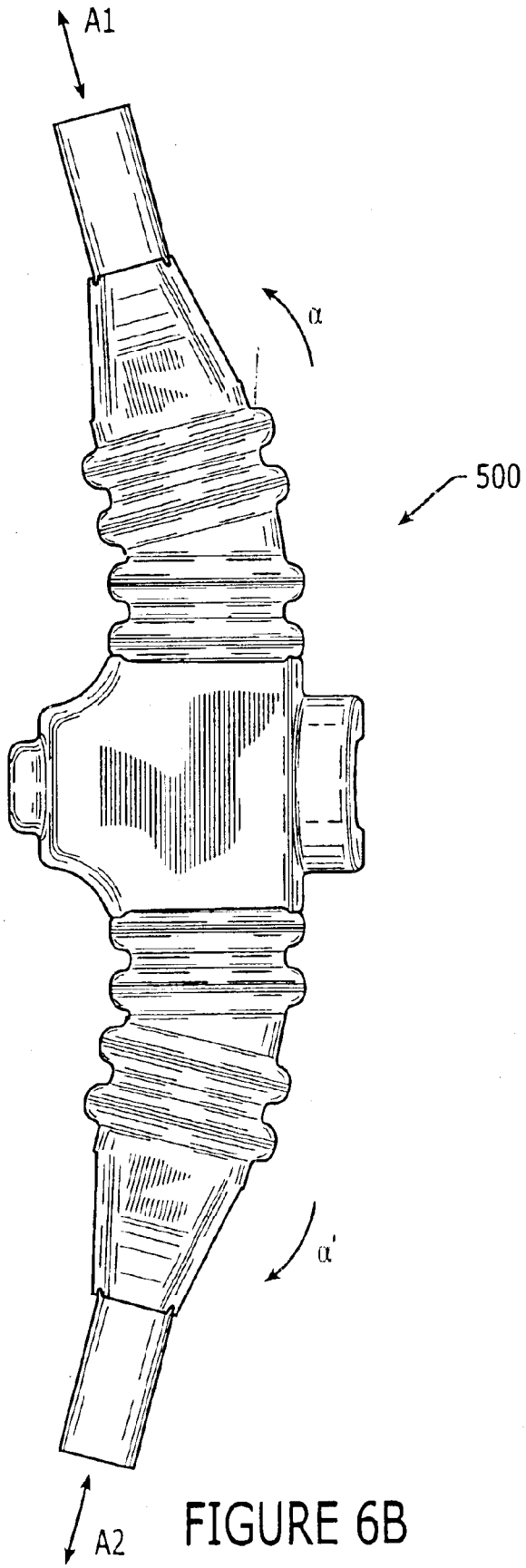
FIG. 6B is a top plane view of the cover of FIG. 6A in a flexed position.

Covers according to various embodiments of the present invention will now be described further with reference to FIG. 6A and FIG. 6B. FIG. 6A and FIG. 6B are top views of a cover 500 according to embodiments of the present invention in an aligned and flexed position respectively. As illustrated in FIG. 6A, a first axis. A1 is defined by a line extending from the insulator under the cover 500 in a first direction under a first line cover portion. A second axis A2 is defined by a line extending from the cover 500 in a second direction under a second line cover portion. As shown in FIG. 6B, the respective line cover portions extending from the central portion of the cover 500 are flexed with the first line cover portion extending over the axis A1 rotated to an angle $\alpha$ relative to the rest state illustrated in FIG. 6A while the second line cover extending along the axis A2 is rotated to an angle $\alpha'$ relative to the rest state illustrated in FIG. 6A. While the angles $\alpha$, $\alpha'$ are shown as substantially identical in FIG. 6B, it is to be understood that the respective line cover portions may be rotated to different angles as needed based on the angle of approach of the lines extending from an insulator protected by the cover 500. In particular embodiments of the present invention, the flexible material selected for the cover 500 and the configuration of any corrugated portions are selected to provide a rotational flexibility of the line cover portions to accommodate a deviation of up to about 25 degrees between the axis A1 and the axis A2.

Figure 7A:
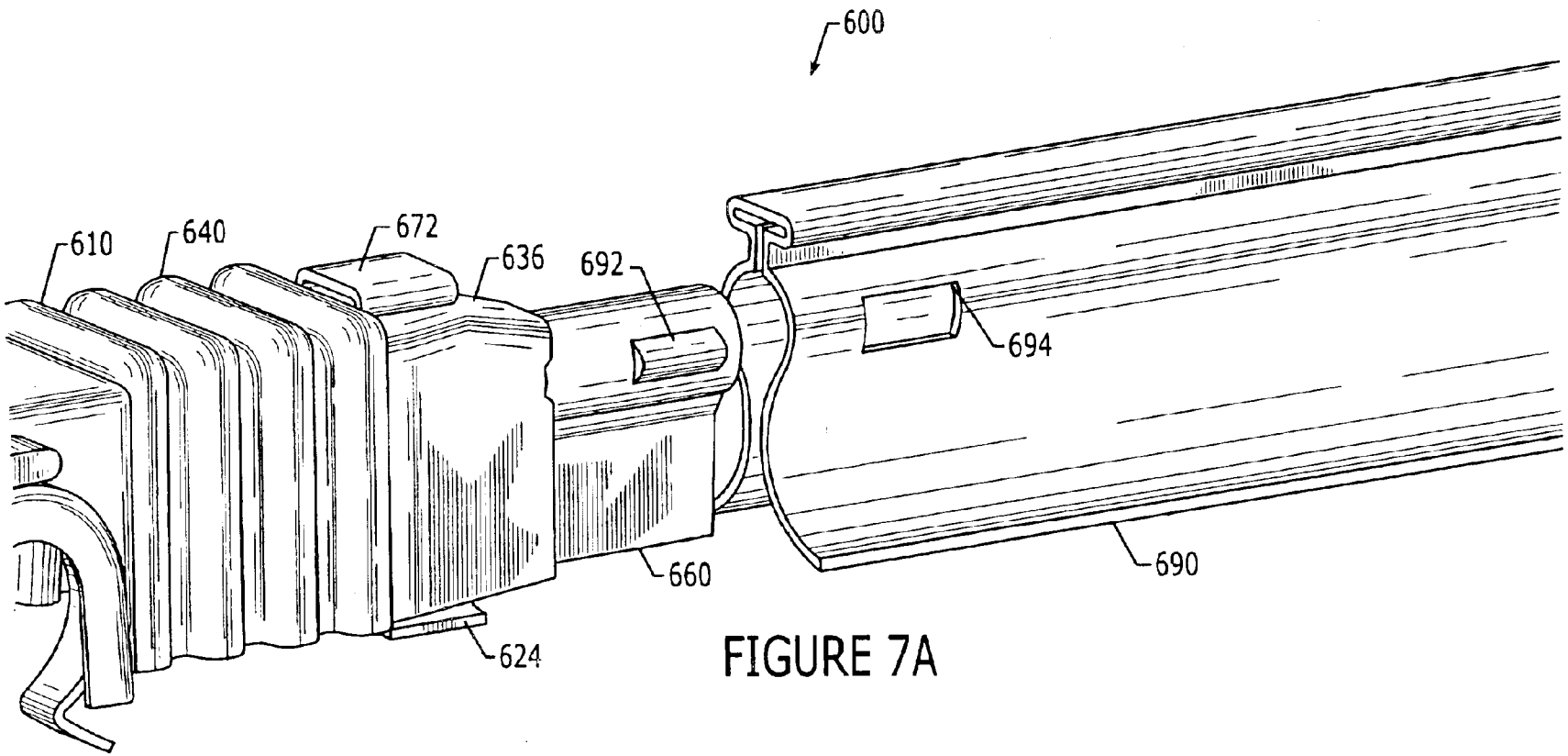
FIG. 7A is a perspective view of a cover for distribution lines with an engagement arm adjacent the main body according to some embodiments of the present invention.
Figure 7B:
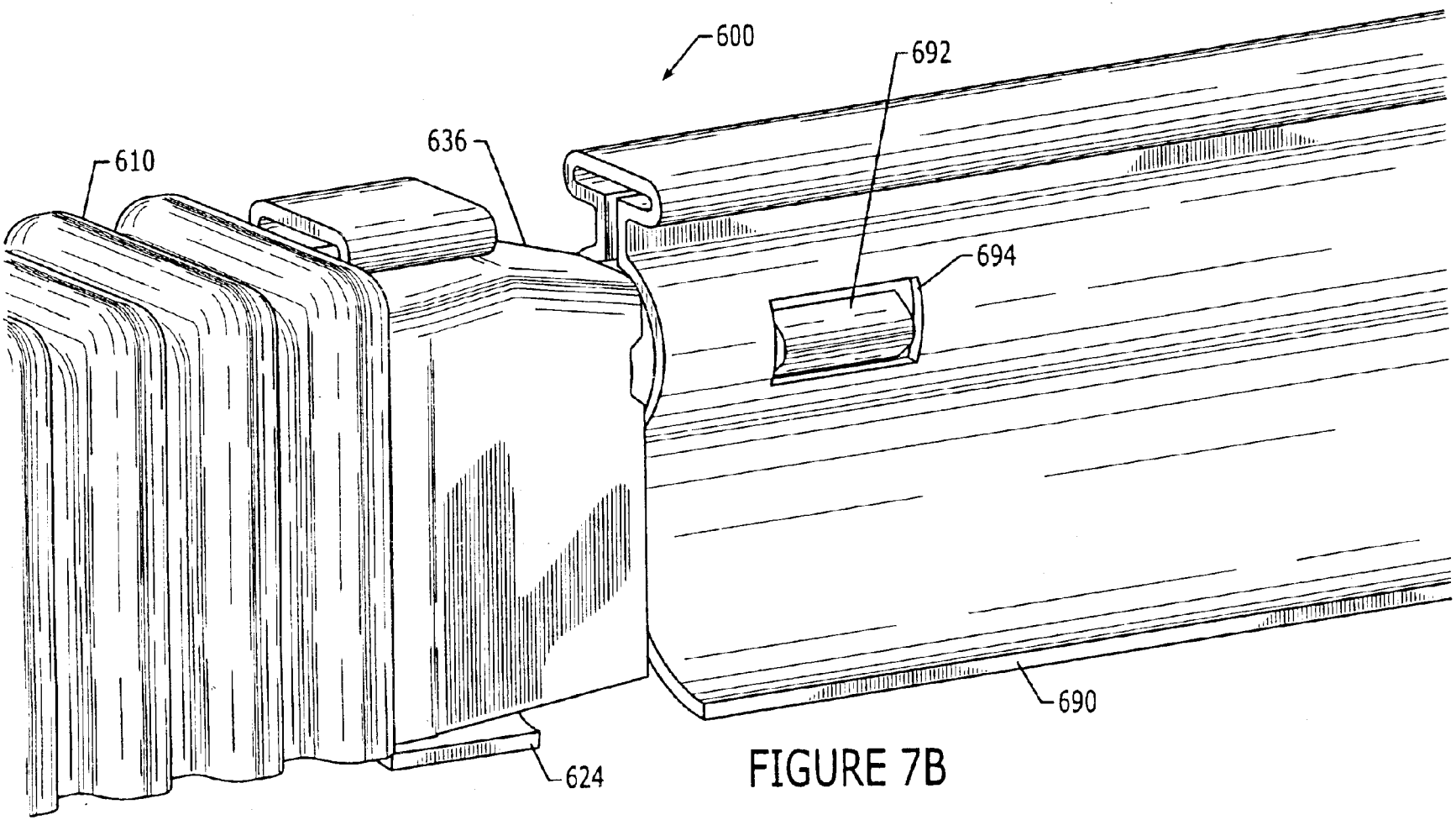
FIG. 7B is a perspective view of the cover of FIG. 7A with the engagement arm coupled to the main body.

Referring now to FIGS. 7A and 7B, further embodiments of the present invention including a detachable extender arm will now be further described. FIG. 7A is a perspective view showing the extender arm 690 detached from the main body 610 of the cover 600 while FIG. 7B shows the extender arm 690 connected to the main body 610 of the cover 600. FIGS. 7A and 7B illustrate only one line cover portion 636 but it is to be understood that, in various embodiments of the present invention, a second line cover portion having a substantially identical configuration may be provided for the main body 610 to allow the cover 600 to include extender arms 690 attached to each of a plurality of line cover portions.

As shown in FIG. 7A, a connector member 624 is molded into the main body 610 in a connector receiving portion 672 of the main body 610. The line cover portion 636 includes a corrugated portion 640 and an extender arm connector portion 660. For the particular embodiments illustrated in FIG. 7A, a releasable snap connector 692, 694 couples the extender arm 690 to the line cover portion 636 at the extender arm connector portion 660. More particularly, for the embodiments illustrated in FIG. 7A, the releasable snap connector includes a tab portion 692 on the extender arm connector portion 660 and a corresponding opening 694 positioned on the extender arm 690 so as to engage the tab 692 when the extender arm 690 is positioned over the connector portion 660. However, it is to be understood that the tab 692 may be provided on the extender arm 690 with the opening on the connector portion 660 of the main body 610. It is also to be understood that, while illustrated in FIG. 7B with the extender arm 690 positioned over the connector portion 660, in further embodiments of the present invention, the connector portion 660 may be positioned over the extender arm 690.

In various embodiments of the present invention, the extender arm 690 is a rigid material. In particular embodiments, the connector member 624 and the extender arm 690 may be the same material. Furthermore, as illustrated in FIG. 7A, the connector member 624 may be a displacement clip and the extender arm 690 and the connector member 624 may have substantially identical profiles, such as the omega profile illustrated for the extender arm 690 in FIG. 7A.

Figure 8A:
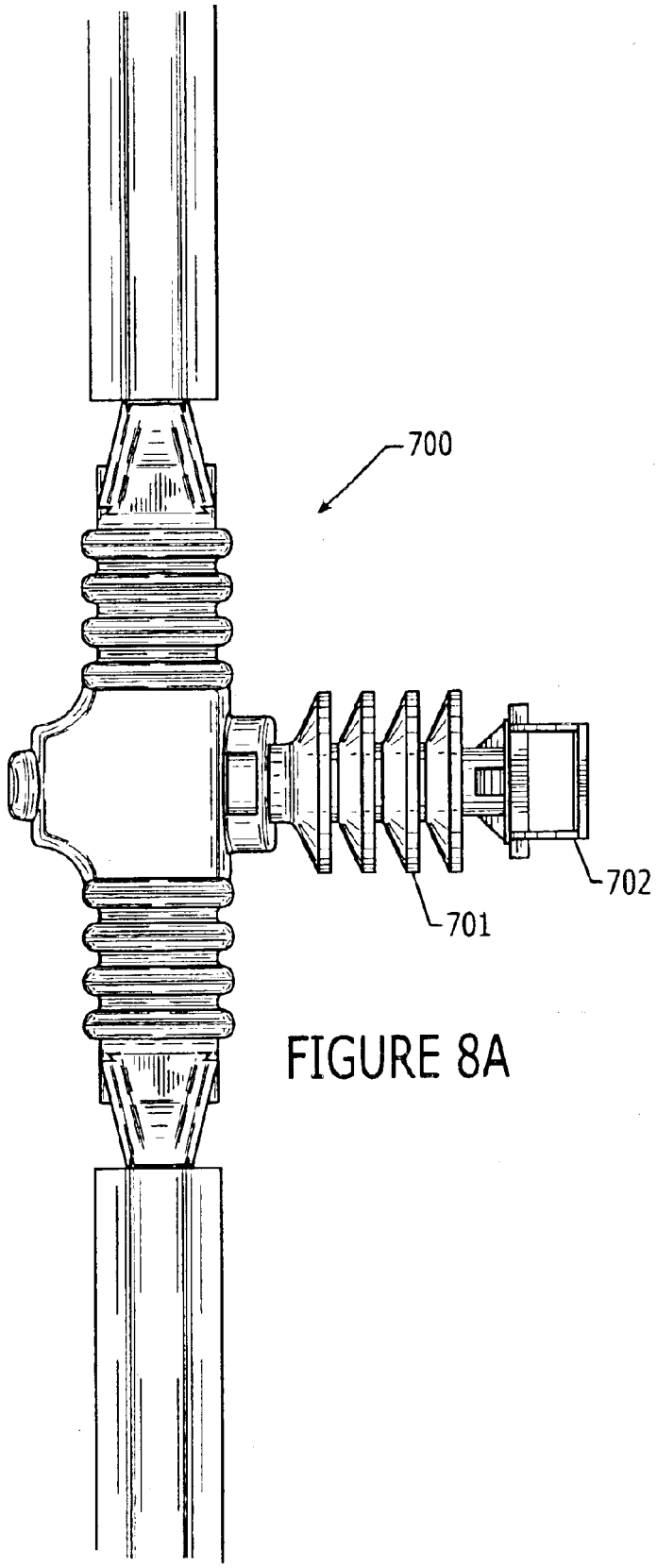
FIG. 8A is a top plane view of a cover for distribution lines over an insulator according to other embodiments of the present invention.
Figure 8B:
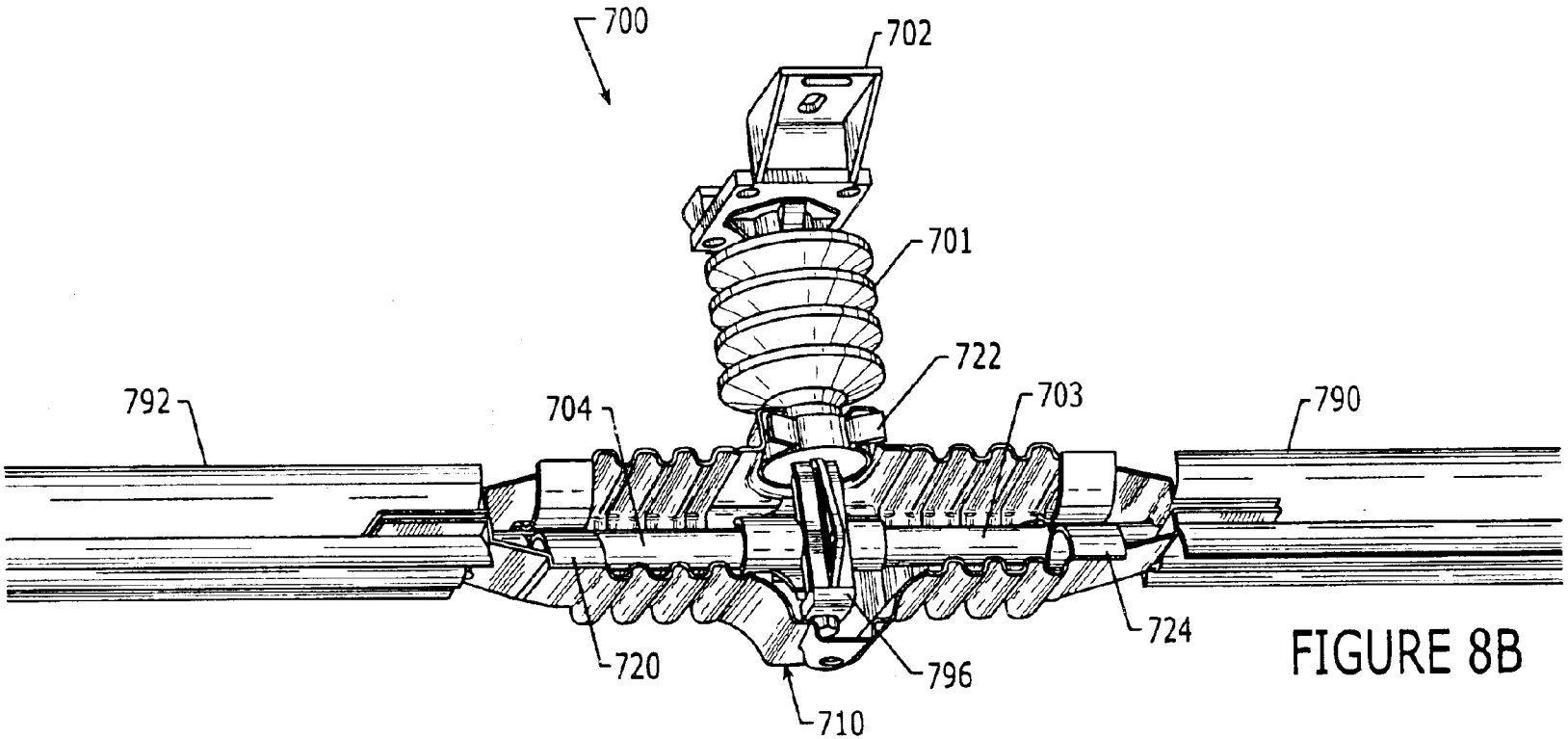
FIG. 8B is a bottom plane view of the cover of FIG. 8A in a flexed position.

FIGS. 8A and 8B are a top plan view and a bottom perspective view of a cover 700 positioned over an insulator 701 and a first distribution line 703 and a second distribution line 704. As shown in FIG. 8B, the first line 703 and second line 704 are a single distribution line extending from the insulator 701 in two directions. The insulator. 701 may be attached to a support structure, such as a utility pole, by a bracket 702. The line 703, 704 is, in turn, connected to the insulator 701 by the connector mechanism 796 as shown in FIG. 8B. Also shown in FIG. 8B are a first extender arm 790 and a second extender arm 792 extending from the main body 710 in substantially opposite directions. A connector member 720 connects the cover 700 to the line 704. A further connector member 724 connects the cover 700 to the line 703. A third connector member 722 connects the cover 700 to the insulator 701.

Figure 8C:
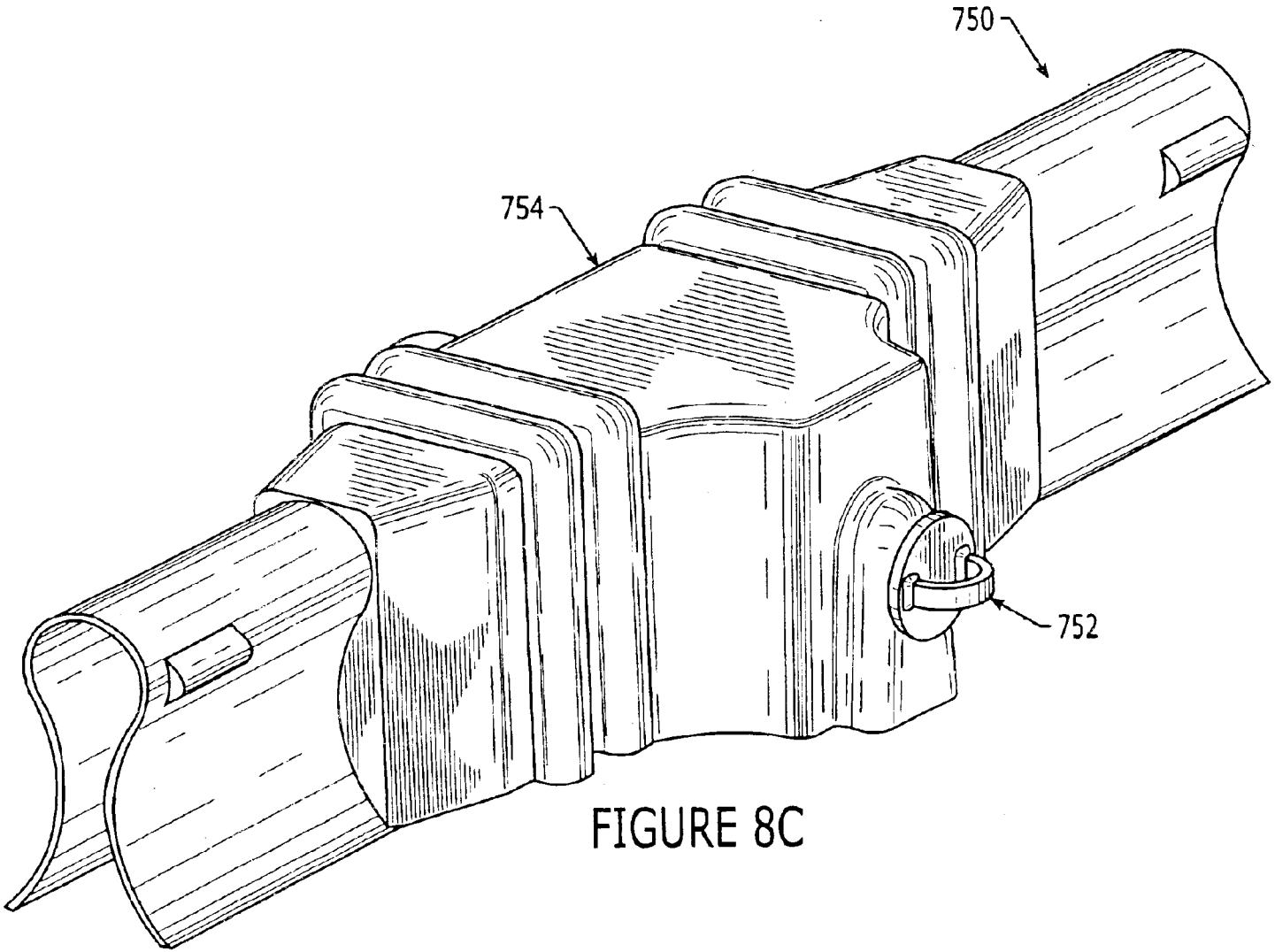
FIG. 8C is a perspective view of a cover for distribution lines according to other embodiments of the present invention.
Figure 8D:
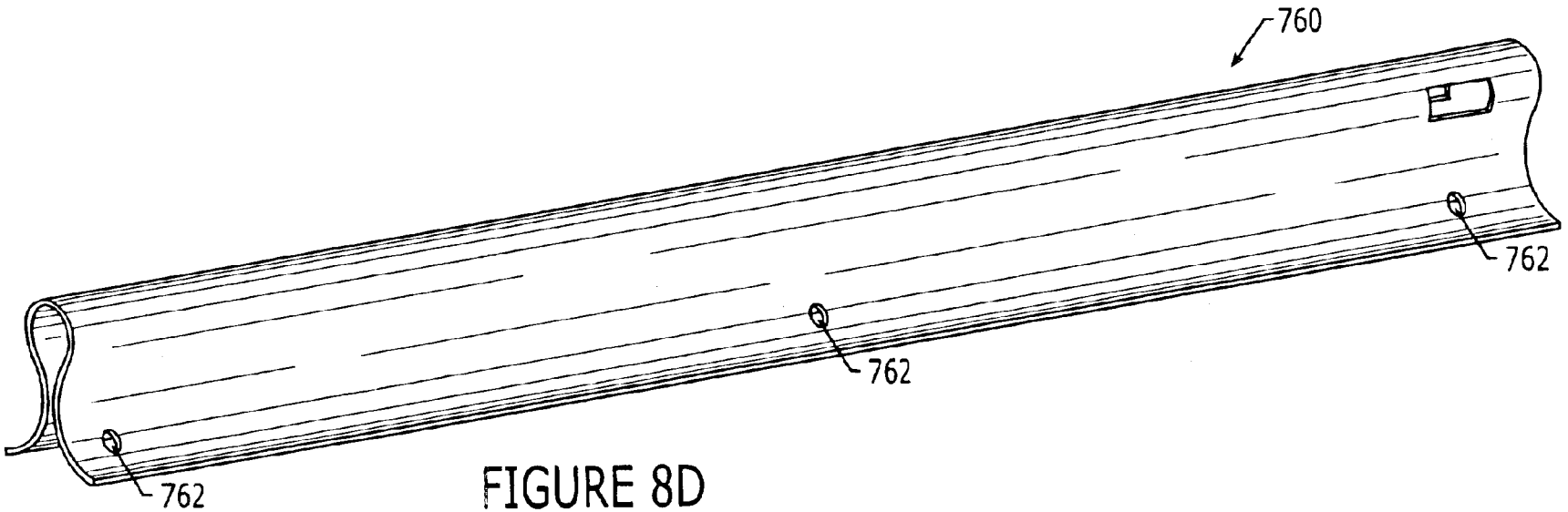
FIG. 8D is a perspective view of an extender arm according to other embodiments of the present invention.

Also shown in the embodiments of FIG. 8C is an installation aid attachment portion 752 in the main body 754 configured to engage an end of an installation arm, such as a hot stick or shot gun, for live installation of the cover 750 on distribution lines. While the attachment portion is illustrated as being in the main body in FIG. 8C, it is to be understood that one or more of the connector members may include the attachment portion for receiving the installation aid. Furthermore, while only one installation aid attachment portion is illustrated, a plurality of installation aid attachment portions may be included in the main body and/or connector members in various embodiments of the present invention. As shown in FIG. 8D, installation aid attachment portion(s) 762 may also be provided in the extender arm 760. The installation aid attachment portion(s) 762 may be provided instead of or in addition to the installation aid attachment portion 752 in the main body 754.

Figure 9:
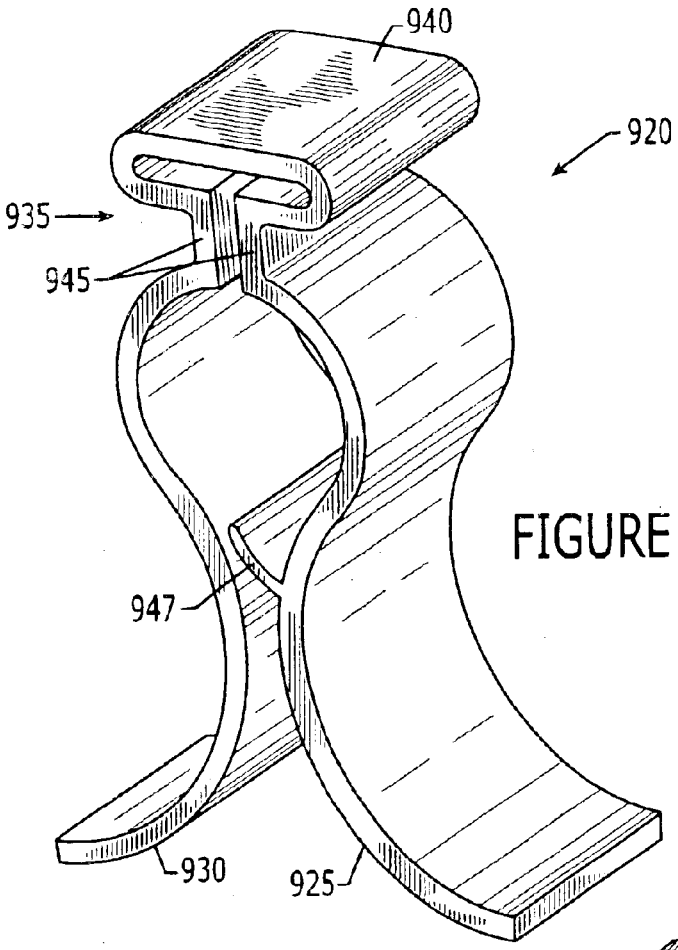
FIG. 9 is a perspective view of an omega clip, displacement spring type connector member according to some embodiments of the present invention.

A variety of different connector members suitable for use with embodiments of the present invention are illustrated in FIGS. 9–12. FIG. 9 illustrates an omega clip type displacement spring connector 920. The omega clip 920, as shown in FIG. 9, includes an upper spring portion 935 including a top portion 940 and arms 945 extending from the top portion 940 to respective clip arms 925, 930. The illustrated connector member 920 also includes a retaining arm 947. The retaining arm 947 has an upward curving profile to facilitate passage of a distribution line into the connector member 920 while resisting removal of the distribution line from the connecting member 920.

Figure 10:
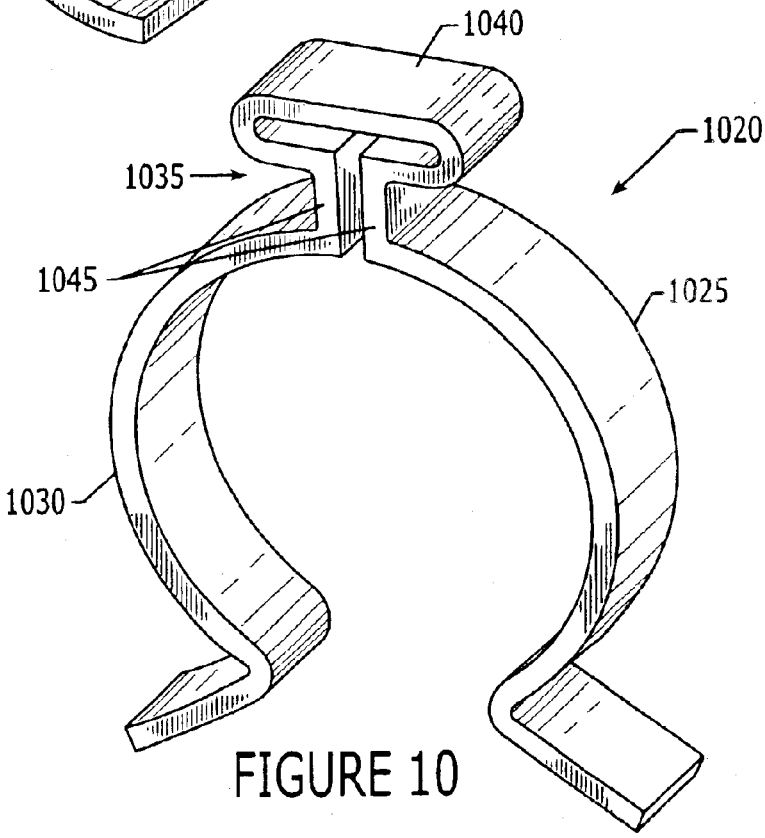
FIG. 10 is a perspective view of a displacement spring type connector member according to other embodiments of the present invention.
Figure 11:
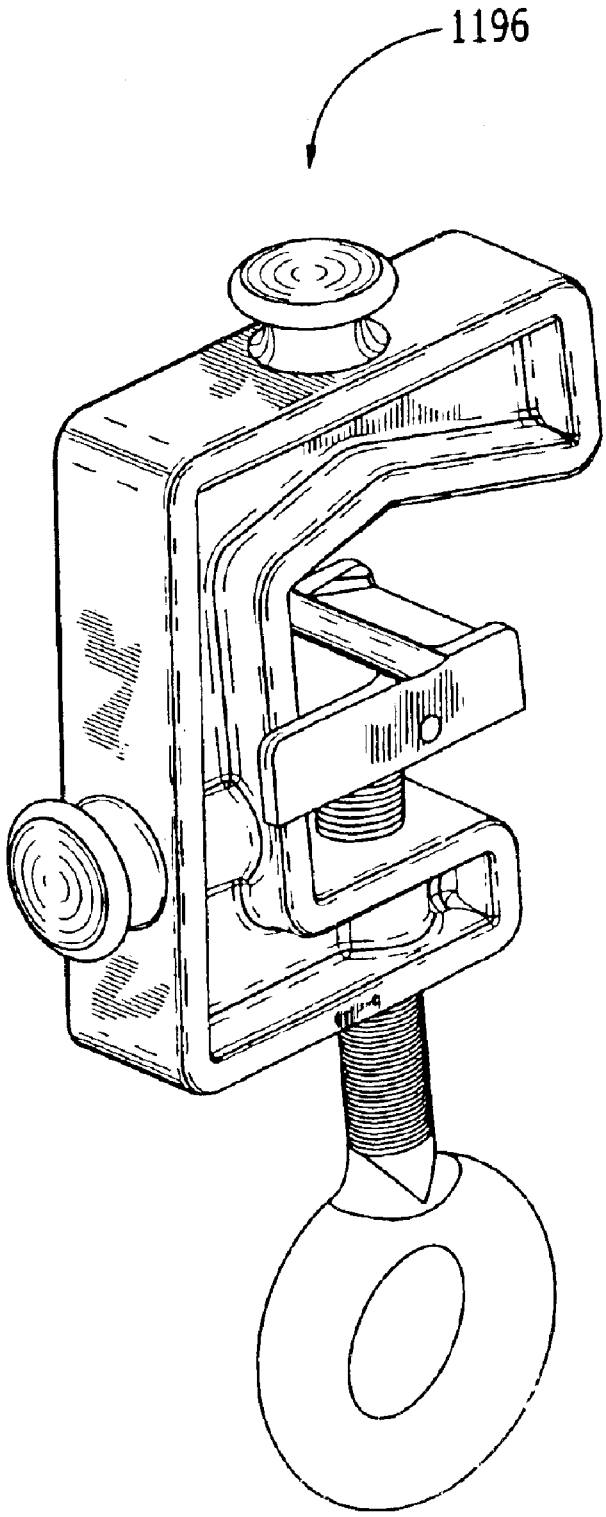
FIG. 11 is a perspective view of a mechanical clamp type connector member according to some embodiments of the present invention.
Figure 12:
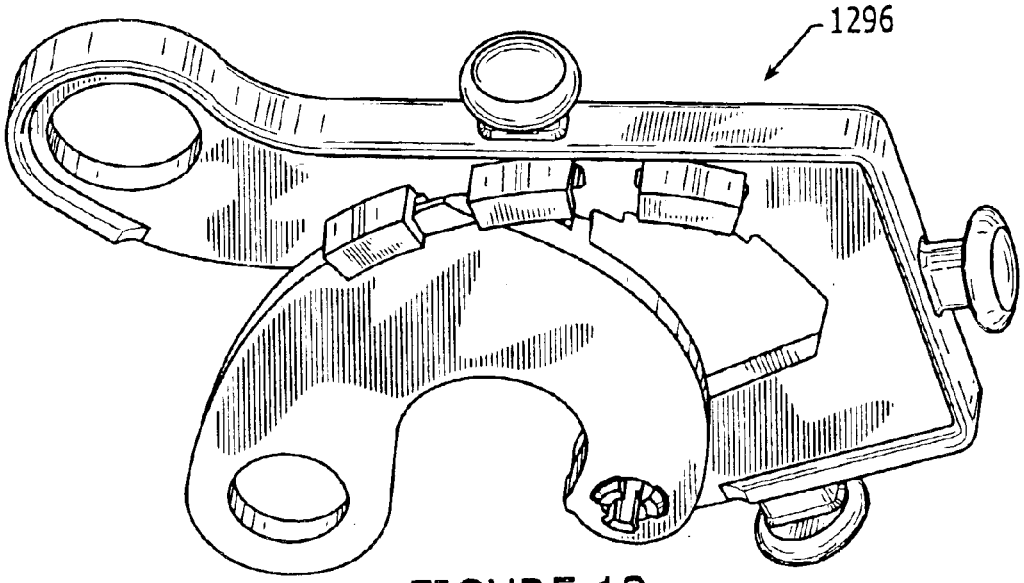
FIG. 12 is a perspective view of a ratcheting clamp type connector member according to some embodiments of the present invention.

A further embodiment of a displacement spring type connector is illustrated in FIG. 10. The connector member 1020 shown in FIG. 10 includes clip arms 1025, 1030 and an upper spring portion 1035 having a top portion 1040 and arms 1045 extending from the top portion 1040 to the clip members 1025, 1030. FIG. 11 illustrates a mechanical clamp connecting member 1196. FIG. 12 illustrates a ratcheting clamp 1296 having a swinging arm.

Figure 13:
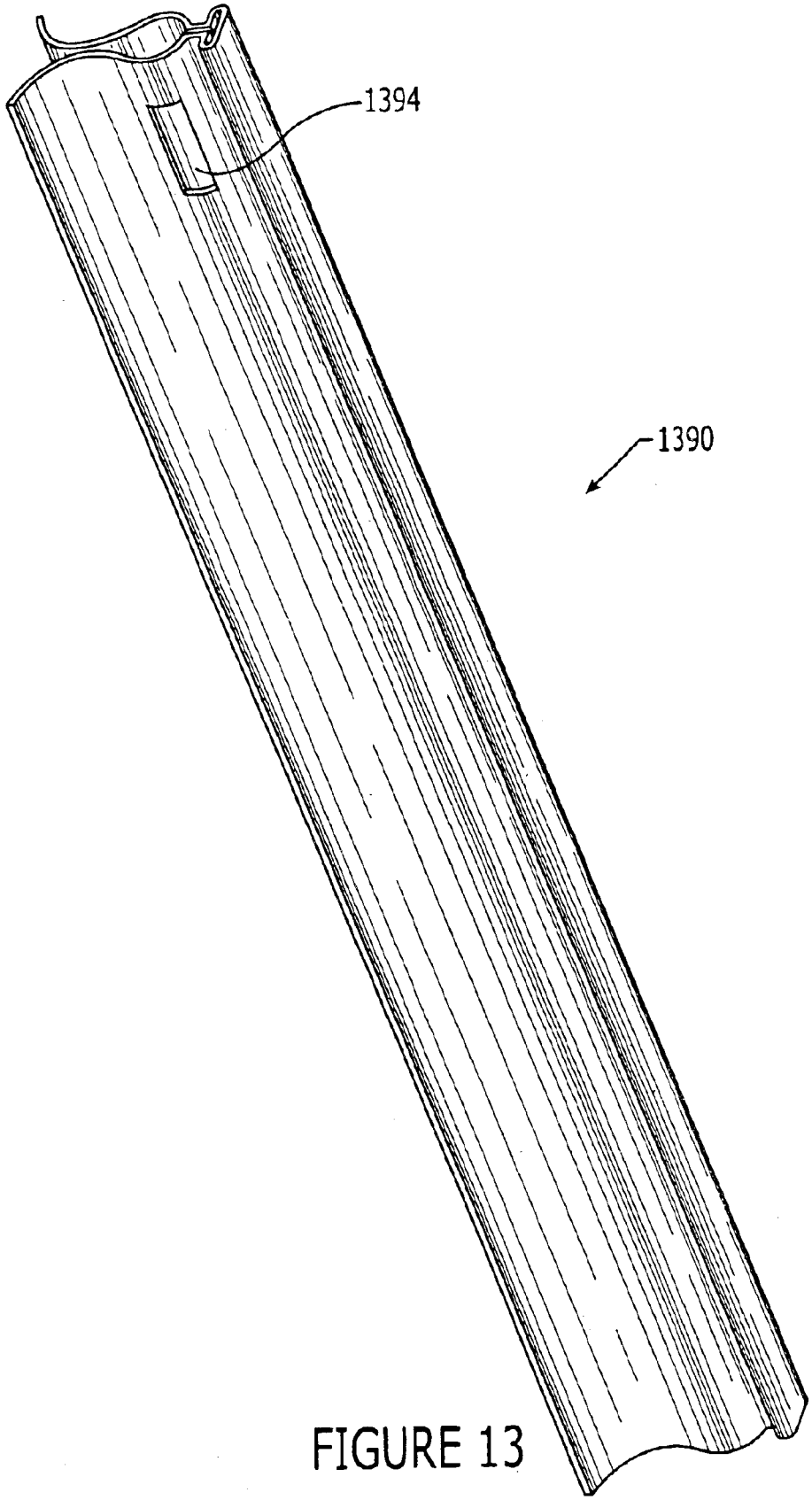
FIG. 13 is a perspective view of an extender arm according to some embodiments of the present invention.

FIG. 13 illustrates an embodiment of an extender arm 1390 having an omega clip profile and an opening 1394 for use in connecting the extender arm 1390 to a main body. It is to be understood that the length of the extender arm 1390 may be selected for particular configurations to provide the desired length of insulating coverage for a line extending from an insulator at a supporting member to provide a desired length of coverage for protection against electric shorting by birds or other animals landing near the cover. Furthermore, it is to be understood that different extender arm lengths may be used in combination for different lines extending from a cover according to various embodiments of the present invention.

Figure 14:
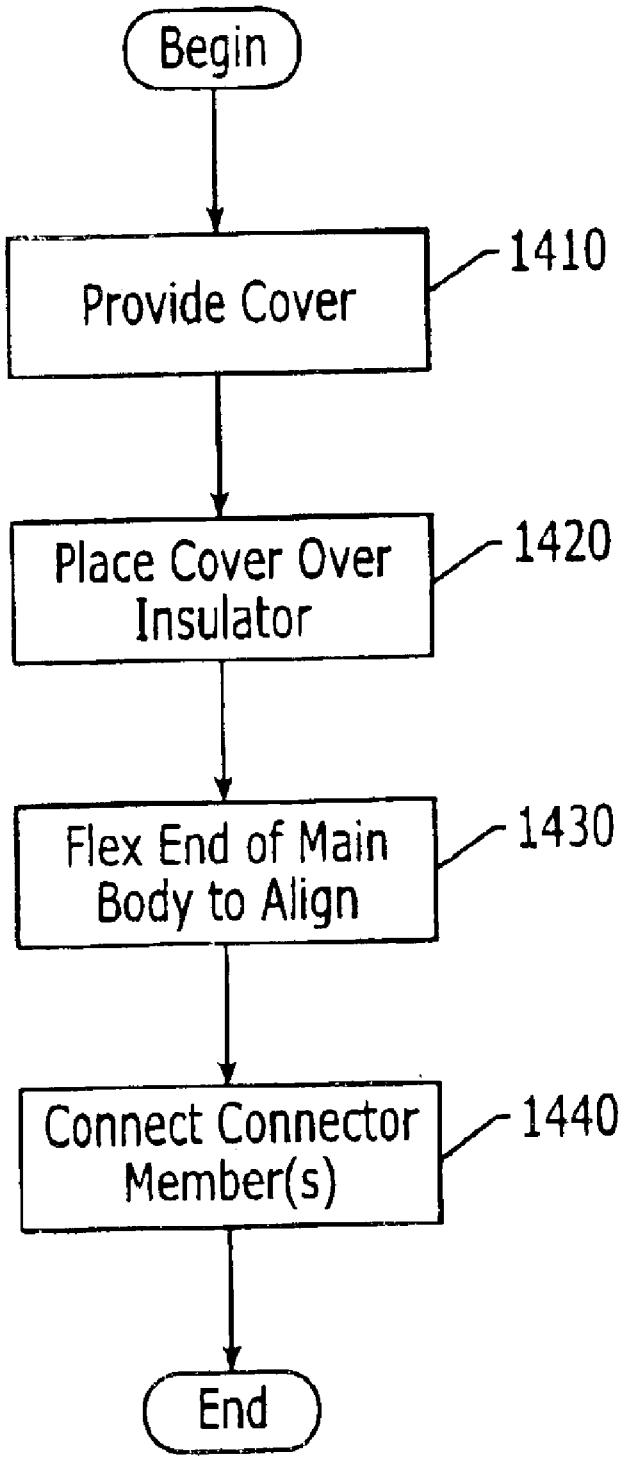
FIG. 14 is a flowchart illustrating methods for covering distribution lines according to some embodiments of the present invention.
Figure 15:
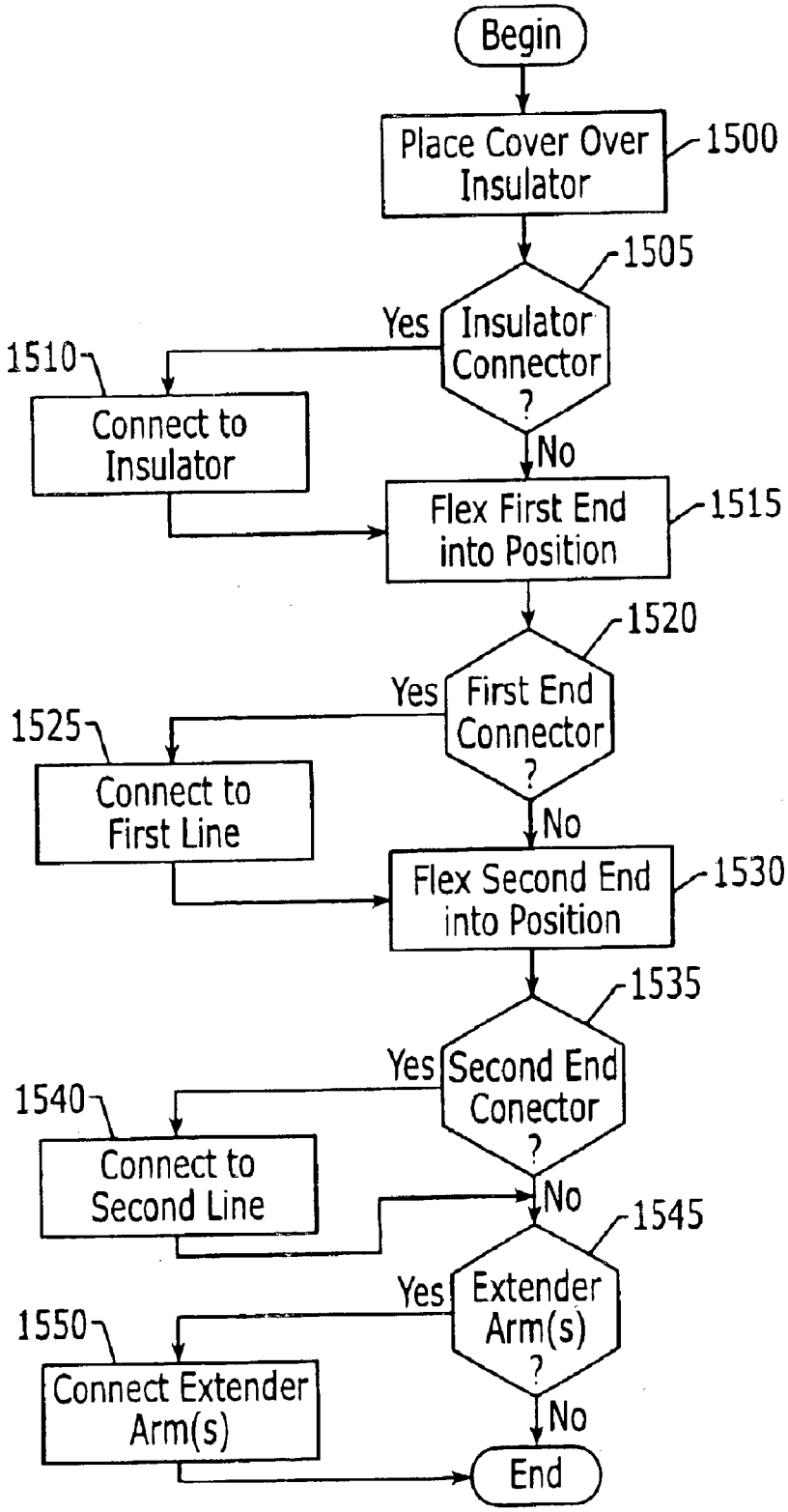
FIG. 15 is a flowchart illustrating methods for covering distribution lines according to other embodiments of the present invention.

The flowcharts of FIGS. 14–15 illustrate the architecture, functionality, and operation of possible implementations of methods for covering distribution lines connected to an insulator according to some embodiments of the present invention. It should be noted that, in some alternative implementations, the acts noted in the blocks may occur out of the order noted in the figures. For example, two blocks shown in succession may, in fact, be executed substantially concurrently, or the blocks may be executed in the reverse order, depending upon the functionality involved.

As shown in the embodiments of FIG. 14, operations for covering distribution lines coupled to an insulator begin at Block 1410 by providing a cover including a main body of a flexible polymer material configured to fit over the insulator and one or more connector members connected to the main body of a rigid material, such as described previously with reference to the various embodiments shown in FIGS. 1–13. The cover is placed adjacent the insulator (Block 1420). The adjacent placement may be fully over and/or partially over and/or aside the insulator. An end of the main body is flexed to align with one of the distribution lines extending from the insulator (Block 1430). One or more connector members of the cover are connected to the insulator and/or the distribution lines (Block 1440).

Methods according to further embodiments of the present invention for covering distribution lines coupled to an insulator will now be described with reference to the flow chart illustration of FIG. 15. For the embodiments illustrated in FIG. 15, operations begin with placing a cover, such as the cover embodiments illustrated in FIGS. 10–13, adjacent the insulator. If the cover includes a connector member for connecting to the insulator (Block 1505), the insulator connector member, is connected to the insulator (Block 1510). A first end of the main body of the cover is flexed to align with a first line extending from the insulator a first direction (Block 1515). If a connector member is provided in the cover for the first end so as to connect to the first line (Block 1520), then the first line connector member is connected to the first line (Block 1525).

For the embodiments illustrated in FIG. 15, a second flexible end is provided in the cover and the second end of the main body is flexed to align with a second line extending from the insulator in a second direction different from the first direction (Block 1530). If a connector member is provided in the second end for connection to the second line (Block 1535), the second end connector member is connected to the second line (Block 1540). If one or more extender arms are desired to be used with the cover (Block 1545), the extender arm(s) are connected to the main body of the cover (Block 1550). One of the extender arms may be positioned connected to the first end of the main body so as to extend over the first line in the first direction while a second extender arm coupled to the second end of the main body may be positioned to extend over the second line in the second direction.

The foregoing is illustrative of the present invention and is not to be construed as limiting thereof. Although a few exemplary embodiments of this invention have been described those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A cover for distribution lines coupled to an insulator, the cover comprising:

a main body comprising a flexible polymer material configured to be positioned adjacent the insulator and at least one line coupled to the insulator; and at least one connector member connected to the main body, the connector member comprising a rigid material configured to couple to and contact at least one of the insulator and the at least one line coupled to the insulator to attach the cover.

2. The cover of claim 1 wherein the main body material has a tensile strength of less than about 2500 pounds per square inch (psi) and the at least one connector member has a tensile strength greater than the main body material and at least about 1200 psi.

3. The cover of claim 2 wherein the main body comprises:

a central portion configured to be positioned adjacent the insulator;

a first line cover portion extending from the central portion; and a second line cover portion extending from the central portion in a direction substantially opposite from the first line cover portion.

4. The cover of claim 3 wherein the first and second line cover portions each comprise a corrugated portion adjacent the central portion that increases rotational flexibility of the line cover portions relative to the central portion.

5. The cover of claim 3 wherein the flexible polymer material and the rigid material comprise track resistant polymer materials.

6. The cover of claim 5 wherein the at least one connector member is selected from the group consisting of a mechanical clamp, a displacement spring clip, a swinging clamp and a ratcheting clamp.

7. The cover of claim 6 wherein the at least one connector member comprises a displacement clip molded into the main body.

8. The cover of claim 6 wherein the at least one connector member comprises a displacement clip and wherein the cover further comprises at least one fastener that couples the at least one connector member to the main body.

9. The cover of claim 8 wherein the at least one fastener comprises a threaded fastener.

10. The cover of claim 5 further comprising an extender arm releasably coupled to the first line cover portion and extending from the central portion.

11. The cover of claim 10 wherein the extender arm comprises the rigid material.

12. The cover of claim 11 wherein the at least one connector member comprises a displacement clip and the extender arm and the at least one connector member have substantially identical profiles.

13. The cover of claim 10 further comprising a second extender arm coupled to the second line cover portion and extending in the direction substantially opposite from the first line cover portion.

14. The cover of claim 10 further comprising a snap connector that couples the extender arm to the first line cover portion.

15. The cover of claim 14 wherein the snap connector comprises a tab portion on an end of one of the first line cover portion and the extender arm and a corresponding opening on an adjacent end of the other of the first line cover portion and the extender arm.

16. The cover of claim 10 wherein the at least one connector member comprises a plurality of connector members and wherein one of the connector members is positioned in the first line cover portion to couple to a line extending from the insulator in a first direction and another of the connector members is positioned in the second line cover portion to couple to a line extending from the insulator in a second direction different from the first direction.

17. The cover of claim 16 wherein a rotational flexibility of the first and second line cover portions accommodates a deviation of up to about 25 degrees between an axis defined by a line extending from the insulator under the first line cover portion and an axis defined by a line extending from the insulator under the second cover portion.

18. The cover of claim 17 wherein the line extending from the insulator under the first line cover portion and the line extending from the insulator under the second cover portion are the same line.

19. The cover of claim 17 wherein the cover further comprises an installation aid attachment portion in at least one of the main body and the at least one connector member configured to engage an end of an installation aid for installation of the cover on the distribution lines.

20. The cover of claim 17 wherein a third of the connector members is positioned in the central portion to couple to the insulator.

21. The cover of claim 1 wherein the flexible polymer material and the rigid material comprise track resistant polymer materials.

22. The cover of claim 1 wherein the at least one connector member comprises a plurality of connector members and wherein one of the connector members is positioned to couple to a line extending from the insulator in a first direction and another of the connector members is positioned to couple to a line extending from the insulator in a second direction different from the first direction.

23. The cover of claim 1 wherein the main body has a rotational flexibility that accommodates a deviation of up to about 25 degrees between an axis defined by a line extending from the insulator under the main body in a first direction and an axis defined by a line extending from the insulator under the main body in a second direction.

24. The cover of claim 1 wherein the cover further comprises an installation aid attachment portion in at least one of the main body and the at least one connector member configured to engage an end of an installation aid for installation of the cover on the distribution lines.

25. A method for covering distribution lines coupled to an insulator, the method comprising:

providing a cover comprising a main body comprising a flexible polymer material configured to fit over the insulator and at least one connector member connected to the main body, the connector member comprising a rigid material;

placing the cover adjacent the insulator;

flexing an end of the main body to align with one of the distribution lines extending from the insulator; and connecting the at least one connector member directly to at least one of the insulator or the one of the distribution lines.

26. The method of claim 25 wherein the at least one connector member is positioned in the end of the main body and wherein connecting the at least one connector member comprises connecting the at least one connector member to one of the distribution lines.

27. The method of claim 25 wherein the at least one connector member comprises a plurality of connector members and wherein flexing an end of the main body comprises flexing a first end of the main body to align with a first one of the distribution lines extending from the insulator in a first direction and wherein the method further comprises flexing a second end of the main body to align with a second one of the distribution lines extending from the insulator in a second direction, different from the first direction, and wherein connecting the at least one connector member comprises connecting a first one of the connector members in the first end to the first one of the distribution lines and connecting a second one of the connector members in the second end of the main body to the second one of the distribution lines.

28. The method of claim 27 wherein the first end and the second end comprise a corrugated portion adjacent a central portion of the main body positioned between the first and second end that increases rotational flexibility of the first and/or second end of the main body relative to the central portion of the main body and wherein flexing the first end and flexing the second end comprise flexing the ends at the corrugated portion.

29. The method of claim 27 wherein connecting the at least one connector member further comprises connecting a third one of the connector members positioned in the main body to the insulator.

30. The cover of claim 29 wherein the main body has a rotational flexibility that accommodates a deviation of up to about 25 degrees between an axis defined by one of the distribution lines extending from the insulator under the main body in the first direction and an axis defined by one of the distribution lines extending from the insulator under the main body in the second direction.

31. The method of claim 29 further comprising connecting an extender arm to the first end of the main body, the extender arm being positioned to extend over the first one of the distribution lines in the first direction.

32. The method of claim 31 further comprising connecting another extender arm to the second end of the main body, the another extender arm being positioned to extend over the second one of the distribution lines in the second direction.

33. The method of claim 25 wherein the end of the main body comprises a corrugated end portion adjacent a central portion of the main body that increases rotational flexibility of the end portion relative to the central portion and wherein flexing the end comprises flexing the corrugated end portion.

34. The method of claim 33 wherein the main body has a rotational flexibility that accommodates a deviation of up to about 25 degrees between an axis defined by one of the distribution lines extending from the insulator under the main body in a first direction and an axis defined by one of the distribution lines extending from the insulator under the main body in a second direction.

35. The method of claim 33 further comprising connecting an extender arm to the end of the main body, the extender arm being positioned to extend over the one of the distribution lines extending in the first direction.

36. The method of claim 25 further comprising connecting an extender arm to the end of the main body, the extender arm being positioned to extend over one of the distribution lines.

37. A method for covering distribution lines coupled to an insulator, the method comprising:

providing a cover comprising a main body comprising a flexible polymer material configured to fit over the insulator and at least one connector member connected to the main body, the connector member comprising a rigid material;

placing the cover adjacent the insulator;

flexing an end of the main body to align with one of the distribution lines extending from the insulator; and connecting the at least one connector member to the insulator.

38. A cover for distribution lines coupled to an insulator, the cover comprising:

a main body comprising a flexible polymer material configured to be positioned adjacent the insulator and at least one line coupled to the insulator; and a connector member connected to the main body, the connector member comprising a rigid material coupled to and contacting the insulator to attach the cover.

39. A method for covering distribution lines coupled to an insulator, the method comprising:

providing a cover comprising a main body comprising a flexible polymer material configured to fit over the insulator and at least one connector member connected to the main body, the connector member comprising a rigid material;

placing the cover adjacent the insulator;

flexing an end of the main body to align with one of the distribution lines extending from the insulator; and connecting the at least one connector member to the insulator.

* * * * *